United States Patent [19]

Blenk

[11] Patent Number: 5,048,213

[45] Date of Patent: Sep. 17, 1991

[54] CLOSURE ARRANGEMENT FOR A GUNSTOCK STORAGE SPACE

[76] Inventor: Gerhard Blenk, Schimmelreiterweg 15, 8965 Wertach, Fed. Rep. of Germany

[21] Appl. No.: 599,301

[22] Filed: Oct. 17, 1990

[30] Foreign Application Priority Data

Nov. 28, 1989 [DE] Fed. Rep. of Germany ... 8913997[U]

[51] Int. Cl.[5] ..... F41C 23/22

[52] U.S. Cl. ..... 42/71.01

[58] Field of Search ..... 42/71.01

[56] References Cited

U.S. PATENT DOCUMENTS

| | | | |
|---|---|---|---|
| 1,331,074 | 2/1920 | Marble | 42/71.01 |
| 1,485,456 | 3/1924 | Von Frommer | 42/71.01 |
| 2,763,951 | 9/1956 | Harvey | 42/71.01 |
| 3,618,248 | 11/1971 | Into et al. | 42/71.01 |
| 3,852,904 | 12/1974 | Drevet | 42/71.01 |
| 4,697,367 | 10/1987 | Brophy | 42/71.01 |

*Primary Examiner*—Michael J. Carone

*Attorney, Agent, or Firm*—Flynn, Thiel, Boutell & Tanis

[57] ABSTRACT

The closure arrangement for a gunstock storage space comprises a holding plate (6) which can be attached to the butt plate and which is provided with an essentially rectangular access opening through which a storage recess (3) provided in the butt (1) is accessible. The holding plate (6) is provided with undercut portions (11) at two opposed longitudinal edges of the access opening. A closure plate (7) is provided with an essentially rectangular attachment (7a) engaging in the access opening and comprising at its longitudinal edges projections (12) which can be inserted under the undercut portions (11) and engage behind the undercut portions (11) in the latched position of the closure plate (7), such that the closure plate (7) together with a stock cap (8) attached thereto and made of soft rubber can be completely removed from the butt (1).

4 Claims, 2 Drawing Sheets

CLOSURE ARRANGEMENT FOR A GUNSTOCK STORAGE SPACE

Figure 1:
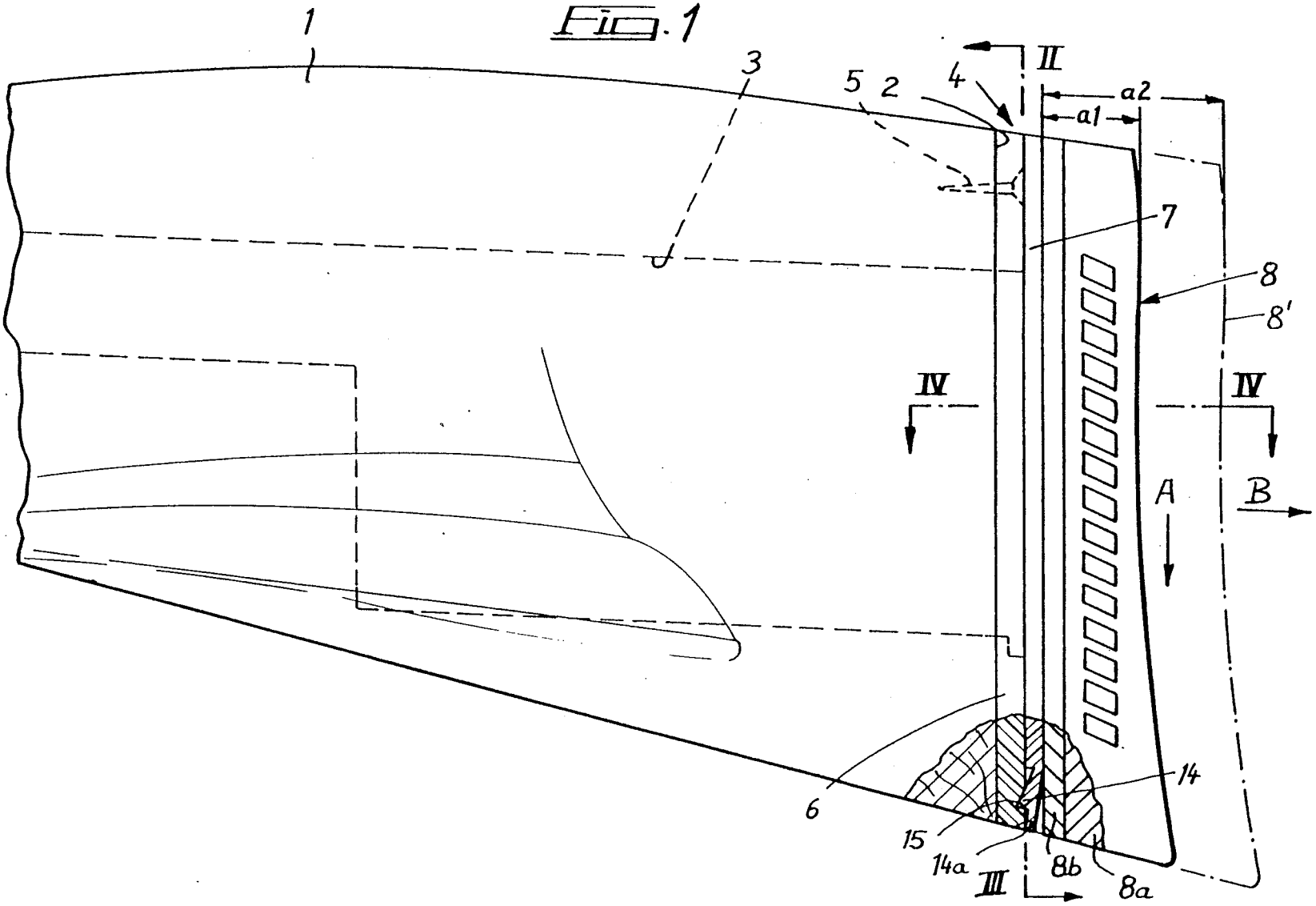

The invention concerns a closure arrangement for a gunstock storage space, with a holding plate which can be attached to the butt plate and which comprises an essentially rectangular access opening through which a storage recess provided in the butt is accessible, with a closure plate which can be latched on the holding plate and which in the latched position closes the access opening, and with a stock cap preferably made of soft rubber which is connected to the closure plate.

Rifle butts can be provided with a storage recess extending in the longitudinal direction of the butt and opening towards the butt plate. This storage recess serves to accommodate some cartridges as an emergency supply and possibly also a multi-part cleaning rod which can be screwed together, a calibre-reducing tube, a knife, a torch or the like. So that the storage recess is accessible and also readily closable again, the closure arrangement mentioned above is provided. The rear closure of this closure arrangement is formed by the stock cap which may be made of any suitable material. Preferably the stock cap for sporting guns and mountain carbines with strong recoil is made of soft rubber with a hard rubber or plastic fixing plate which serves for fixing to the closure plate.

In the known closure arrangement, the closure plate is connected at its upper end to the holding plate so as to allow pivoting about a pivot shaft extending transversely to the butt axis. At the lower end of the access opening is provided a spring-loaded latch pin which latches in a latching recess of the closure plate, and normally holds the latter in the latched position. To open the storage space the latch pin is pressed, whereby the closure plate is released and it can be pivoted rearwardly together with the stock cap attached thereto. The closure plate and the stock cap then, in the open position, extend roughly in the longitudinal direction of the stock and hinder access to the storage recess. In order for the relatively small closure plate, which in the latched position fully engages in the access opening, to have sufficient strength, at least the closure plate must be made of metal (aluminium) and is therefore expensive to make. Another basic disadvantage of the known closure arrangement also lies in that the closure plate is always rigidly connected to the holding plate by the pivot shaft. The stock cap can therefore be released from the stock only by undoing the retaining screws with which the stock cap is attached to the closure plate. Replacement of the stock cap by a stock cap of a different length is, however, always desirable if it is wished to change the length of the butt. This is necessary e.g. when changing over from summer to winter hunting, in order to shorten the length of the butt to match the thicker winter clothing.

It is therefore the object of the invention to provide a closure arrangement for a stock storage space of the kind mentioned hereinbefore, in which the closure plate together with the stock cap attached thereto can easily and without tools be removed from the holding plate, so that on the one hand the storage recess is freely accessible and on the other hand the closure plate can be replaced by another one with a longer or shorter stock cap attached thereto.

This is achieved according to the invention by the fact that the holding plate is provided with undercut portions at two opposed longitudinal edges of the access opening and that the closure plate is provided with an essentially rectangular attachment engaging in the access opening and comprising at its longitudinal edges projections which can be inserted under the undercut portions and engage behind the undercut portions in the latched position of the closure plate, such that the closure plate together with the stock cap attached thereto can be completely removed from the butt.

Owing to this design, the closure plate together with the stock cap attached thereto can be completely removed from the butt and the storage recess is thus accessible without obstacles. Moreover it is an essential advantage that in this way the stock cap is readily replaceable. One need only pull the closure plate with the stock cap attached thereto off the holding plate and can then insert another closure plate with a longer or shorter stock cap in the undercut portions of the holding plate and thus attach it to the butt. Replacement of the stock cap is thus possible with only two manipulations in a very short time and without any tool.

Figure 2:
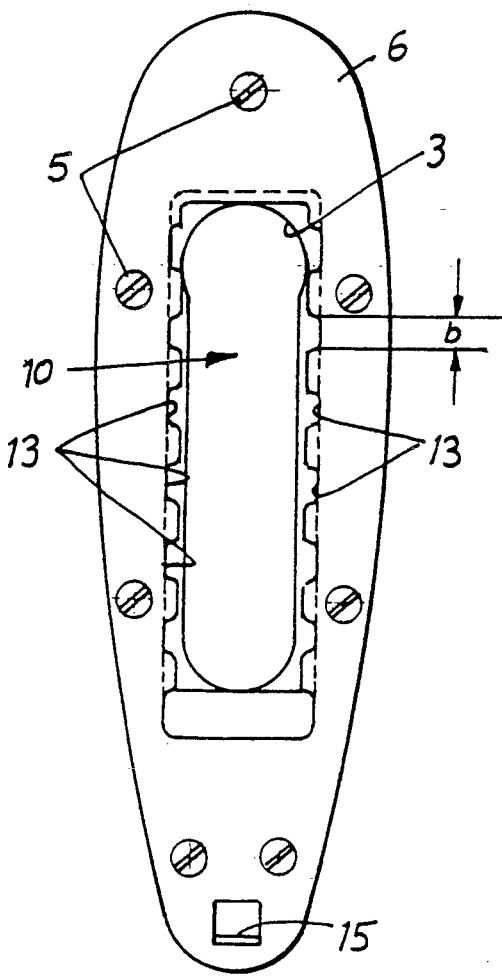
Figure 3:
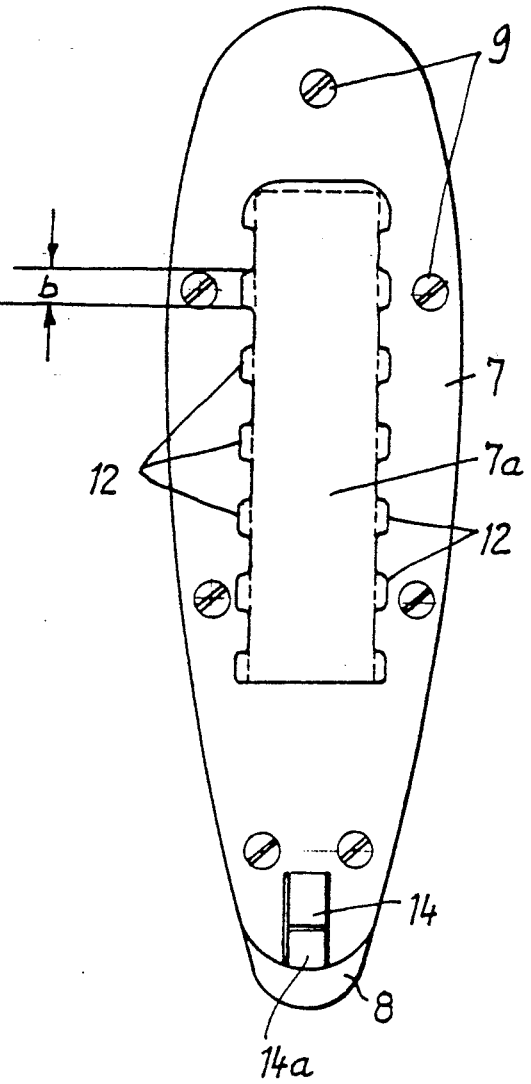
Figure 4:
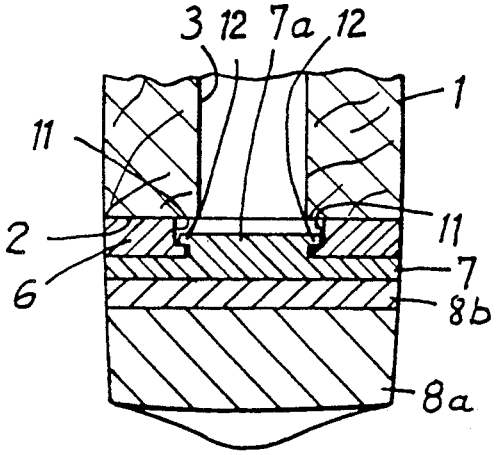

Other advantageous developments of the invention are characterised in the subsidiary claims. The invention is explained in more detail below, with reference to a practical example shown in the drawings. These show:

FIG. 1 a side view of the butt with the closure arrangement, partially in longitudinal section, FIG. 2 a view of the holding plate in direction II of FIG. 1, FIG. 3 a view of the closure plate in direction III of FIG. 1, FIG. 4 a partial cross-section through line IV—IV of FIG. 1.

In the drawings, 1 denotes the butt which comprises a storage recess 3 opening towards the butt plate 2. The closure arrangement which is marked 4 as a whole is provided for the closure of this storage recess 3. This closure arrangement essentially consists of a holding plate 6 which can be attached to the butt plate 2 by several screws 5, a closure plate 7 and the stock cap 8. The stock cap 8 may consist in a known manner of a soft rubber portion 8*a* and a fixing plate 8*b* which may be made of hard rubber or plastic. Portions 8*a* and 8*b* are vulcanised together or glued to each other. The closure plate 7 is rigidly connected to the fixing plate 8*b* by several screws 9 or by some other fastening.

The holding plate 6 comprises an essentially rectangular access opening 10. At two opposed longitudinal edges of the access opening 10, the holding plate 6 is provided with undercut portions 11. The closure plate 7 comprises an essentially rectangular attachment 7*a* engaging in the access opening 10. This attachment 7*a* is provided at its longitudinal edges with several projections 12 which can be inserted under the undercut portions 11. In the latched position of holding plate 6 and closure plate 7 shown in FIGS. 1 and 4, the projections 12 engage behind the undercut portions 11, as can be seen in FIG. 4.

Advantageously, at the longitudinal edges of the access opening 10 are provided several spaced-apart notches 13. These notches 13 are so deep in relation to the longitudinal edges that there are no longer any undercut portions in the region of the notches 13. The projections 12 on the attachment 7*a* are mutually spaced apart by a distance which corresponds to the mutual distance between the notches 13. The size of the projections 12 also corresponds to some extent to the size of the notches 13, which however are slightly larger, so that the projections 12 can easily pass through the notches 13. Moreover the projections 12 are offset from the notches 13 approximately by the width b of a projection 12 or notch 13, so that in the latched position they are offset from the notches 13 by the same amount b and can engage behind the undercut portions 11.

As can also be seen in FIG. 2, the recess 10 is surrounded on all sides by the holding plate 6 and therefore does not open towards any side of the holding plate. The result of this is that when the closure plate 7 is fitted, the access opening 10 is completely invisible and also the entry of foreign bodies into the storage recess 3 is prevented.

Furthermore, the closure plate 7 appropriately comprises a spring locking catch 14 projecting towards the holding plate 6. The holding plate 6 is in turn provided in the region of the locking catch with a latching recess 15 for the locking catch. The locking catch 14 in the latched position of the closure plate 7 engages in the latching recess 15, as shown in FIG. 1, and thus prevents the closure plate 7 from sliding relative to the holding plate 6 in the longitudinal direction of the two plates.

The holding plate 6 and the closure plate 7 are appropriately made of plastic.

To open the storage recess 3, the tongue 14*a* of the locking catch 14 is pressed rearwardly for example with a fingernail. The closure plate 7 can now be pushed down in the direction of arrow A relative to the holding plate 6 according to FIG. 1. As a result the proJections 12 pass into the region of the notches 13. If the stock cap 8 is now pulled rearwardly in direction B relative to the butt 1, then the projections 12 pass through the notches 13, and the stock cap 8 and closure plate 7 can be completely removed from the butt 1. The storage recess 3 is thus freely accessible. Conversely, to close the storage recess 3 the closure plate 7 is fitted onto the holding plate 6 in the direction opposite the arrow b, wherein the projections 12 pass through the notches 13. By sliding the closure plate 7 in the direction opposite the arrow A, the projections 12 again pass behind the undercut portions 11. When the holding plate 6 and the closure plate 7 are again completely aligned, the locking catch 14 latches in the latching recess 15. Closure plate 7 and stock cap 8 are therefore again attached securely to the butt 1.

If the stock cap 8, which in the embodiment shown has a length a1, is to be exchanged for the stock cap 8' of length a2 shown in dot-dash lines, then the closure plate 7 is released from the holding plate 6 in the manner described. Attached to the other stock cap 8' is an identical closure plate 7 which can then in turn be fitted onto the holding plate 6 in the manner described and latched there.

I claim:

1. Closure arrangement for a gunstock storage space, with a holding plate which can be attached to the butt plate and which comprises an essentially rectangular access opening through which a storage recess provided in the butt is accessible, with a closure plate which can be latched on the holding plate and which in the latched position closes the access opening, and with a stock cap preferably made of soft rubber which is connected to the closure plate, characterised in that the holding plate (6) is provided with undercut portions (11) at two opposed longitudinal edges of the access opening (10) and that the closure plate (7) is provided with an essentially rectangular attachment (*7a*) engaging in the access opening (10) and comprising at its longitudinal edges projections (12) which can be inserted under the undercut portions (11) and engage behind the undercut portions (11) in the latched position of the closure plate (7), such that the closure plate (7) together with the stock cap (8) attached thereto can be completely removed from the butt (1).

2. Closure arrangement according to claim 1, characterised in that at the longitudinal edges of the access opening (10) are provided several spaced-apart notches (13) and that the attachment (*7a*) comprises at each longitudinal edge several spaced-apart projections (12), the size and arrangement of which correspond approximately to the size and arrangement of the notches (13) and which in the latched position are offset from the notches (13) approximately by the length (b) of a notch (13).

3. Closure arrangement according to claim 1, characterised in that the access opening (10) is surrounded on all sides by the holding plate (6).

4. Closure arrangement according to claim 1, characterised in that at the lower end of the closure plate (7) is provided a spring locking catch (14) projecting towards the holding plate (6) and that the holding plate (6) comprises a latching recess (15) for the locking catch (14), in which the latter engages in the latched position of the closure plate (7).

* * * * *